US007607441B2

(12) United States Patent
Hrymoc

(10) Patent No.: US 7,607,441 B2
(45) Date of Patent: Oct. 27, 2009

(54) DEVICE FOR PACKAGING AND APPLYING A COSMETIC PRODUCT

(75) Inventor: Rafal Hrymoc, Monroe Township, NJ (US)

(73) Assignee: L'Oreal, Paris (FR)

( * ) Notice: Subject to any disclaimer, the term of this patent is extended or adjusted under 35 U.S.C. 154(b) by 179 days.

(21) Appl. No.: 11/410,066

(22) Filed: Apr. 25, 2006

(65) Prior Publication Data

US 2006/0239753 A1 Oct. 26, 2006

Related U.S. Application Data

(60) Provisional application No. 60/674,295, filed on Apr. 25, 2005.

(51) Int. Cl.
*A45D 40/26* (2006.01)

(52) U.S. Cl. ..... 132/218; 401/129; 401/122

(58) Field of Classification Search ..... 132/218, 132/73, 73.5, 74.5, 75, 313, 320, 293, 294; 401/118, 121, 124, 126, 128, 129, 122
See application file for complete search history.

(56) References Cited

U.S. PATENT DOCUMENTS

| | | | | |
|---|---|---|---|---|
| 4,437,477 | A | 3/1984 | Gueret | |
| 4,446,879 | A | 5/1984 | Gueret | |
| 4,503,872 | A | 3/1985 | Gueret | |
| 5,504,962 | A * | 4/1996 | Byun | 15/184 |
| 5,743,279 | A | 4/1998 | Gueret | |
| 5,803,638 | A | 9/1998 | Gueret | |
| 7,011,098 | B2 * | 3/2006 | Byun | 132/293 |
| 7,104,716 | B2 * | 9/2006 | Petit | 401/129 |
| D547,952 | S * | 8/2007 | Hrymoc et al. | D4/116 |
| 2001/0038769 | A1 | 11/2001 | Gueret | |
| 2002/0021932 | A1 | 2/2002 | Gueret | |
| 2005/0196219 | A1 * | 9/2005 | Habatjou | 401/127 |

FOREIGN PATENT DOCUMENTS

| | | |
|---|---|---|
| EP | 0 923 894 | 6/1999 |
| FR | 2 298 292 | 8/1976 |
| FR | 2 506 580 | 6/1981 |
| FR | 2 521 842 | 2/1982 |

* cited by examiner

*Primary Examiner*—Robyn Doan
*Assistant Examiner*—Rachel R Steitz
(74) *Attorney, Agent, or Firm*—Oblon, Spivak, McClelland, Maier & Neustadt, L.L.P.

(57) ABSTRACT

A device for packaging and applying a cosmetic product includes a container for holding the product. The container can have an opening; an applicator including: a rod; an applicator element at a first end of the rod, a grasping portion connected to a second end of the rod. The applicator can be configured to be attached by snapping onto the container so as to accommodate the applicator element in the container. A wiper element can be fixed in the container in proximity to the opening. The wiper element can be open at its lower end to allow the applicator element to pass through at least partially when the applicator is mounted on the container. The rod can be in leaktight bearing contact substantially perpendicular to the lengthwise axis of the rod on an inner surface of the wiper element thereby closing the container in a leaktight manner when the applicator is mounted on the container.

39 Claims, 3 Drawing Sheets

DEVICE FOR PACKAGING AND APPLYING A COSMETIC PRODUCT

CROSS-REFERENCE TO RELATED APPLICATIONS

This document claims priority to U.S. Provisional Application No. 60/674,295, filed Apr. 25, 2005, the entire contents of which are hereby incorporated by reference.

BACKGROUND OF THE INVENTION

1. Field of the Invention

The invention relates to a device for packaging and applying a cosmetic product. The device is of the applicator type including an applicator element, which can be integral with a grasping portion, the applicator being designed to fit inside a container.

2. Discussion of Background

Such applicators can be used for example to apply to the skin, mucous membranes or other external parts of the body, blushers, foundations, eye shadows, dermatological compositions, anti-wrinkle compositions, body care compositions and the like, presented in powder, cream, gel or lotion form.

A device for packaging and applying a product in powder form is known which includes a container holding the product and an applicator in the form of a brush formed by a handle carrying a tuft of bristles. The device also includes a wiper element made in one piece with the container, the wiper element being in the form of a finger stall slotted at its end to allow the passage of the brush designed to fit into the wiper element. In this position, the brush is simply placed in the wiper element. An additional cap is then screwed onto the container to close the latter by surrounding the handle. The manipulations required to apply the product are less than simple in that it is necessary to shake the device in the closed position, unscrew the cap, then withdraw the brush. Moreover, when the device is shaken, it is possible for powder to escape from the inside of the container to be deposited around the brush handle, inside the cap. The user's fingers are then soiled with product when he/she grasps the handle.

Documents FR 2 506 580 and FR 2 521 842 also describe a device for packaging and applying a product which in this instance is liquid. The device includes a container fitted with a wiper element in the form of a finger stall slotted at its bottom end and an applicator designed to be attached to the container, in particular by snap action. When the applicator is attached to the container, the lower end of the applicator rod bears in a leaktight manner, along the axis of the rod, on a portion of the wiper element. However, such a configuration calls for very close manufacturing tolerances, in that the slightest variation in the position of the applicator on the container when it is snapped in place means that the rod no longer bears against the wiper element in a leaktight manner.

SUMMARY OF THE INVENTION

There is a need to provide a packaging and applicator device which does not present or reduces the drawbacks of the prior art.

A particular object of an embodiment of the invention is to propose such a device that is simple to use.

It is a particular object of an embodiment of the invention to provide such a device that includes a reliable sealing system.

According to a preferred embodiment of the invention, these objects can be achieved by providing a device for packaging and applying a product that includes: a container holding the product to be applied in loose powder form, the container having an opening. The device also includes an applicator including a rod, an applicator element at a first end of the rod, and a grasping portion connected to a second end of the rod. The applicator can be configured to be attached by snapping onto the container so as to accommodate the applicator element in the container. A wiper element can be fixed in the container in proximity to the opening. The wiper element being can be open at its lower end to allow the applicator element to pass through at least partially when the applicator is mounted on the container. The rod can be capable of leaktight bearing contact substantially perpendicular to the lengthwise axis of the rod on an inner surface of the wiper element thereby closing the container in a leaktight manner when the applicator is mounted on the container.

Using a sealing bead, which bears radially on the wiper element, the sealing zone can be relatively large. Leaktight closure with respect to the product can thus be ensured, even when the device is manufactured to a wider tolerance. Development and production conditions can thus be facilitated, thereby facilitating industrial-scale manufacture of the device.

In an embodiment, the rod can include at least one bead bearing in a leaktight manner on the inner surface of the wiper element when the applicator is mounted on the container. As a variant, the rod can include several beads. As a further variant, it can be arranged for the internal surface of the wiper element to include one or more sealing bead(s) instead of the rod, on which the rod is designed to bear in a leaktight manner. The bead(s) can be replaced by a sealing lip.

The wiper element can have a transverse cross-section that diminishes progressively towards its lower end.

The rod can be flat. The term "flat" denotes the fact that the rod defines a structure of limited thickness relative to its other dimensions, and in particular relative to its length.

The applicator can project beyond the wiper element inside the container over only a part of its length. The applicator can in particular project beyond the wiper element inside the container over less than half its length.

The applicator can be a brush. As a variant, the applicator can be tipped with foam which may or may not be flock covered, or made of felt.

The lower end of the applicator can be in proximity to the bottom of the container when the applicator is mounted on the container.

The applicator can include two fixing lugs incorporating a hook designed to snap onto the container, and the two fixing lugs can be mutually parallel.

The fixing lugs can be designed to tilt about an axis perpendicular to the axis of the rod, by moving towards the rod.

The two fixing lugs can be located on either side of the rod.

The grasping portion can include two bearing surfaces.

The container can have a fitted base, the base being capable of attachment to the container by welding or snap action.

The container can include a skirt defining an opening in the container, the skirt extending inside the container, the wiper element being able to be fixed around the skirt.

The container can contain a cosmetic product, in particular an eye shadow, a rouge, a blusher or a foundation.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from the following detailed description of non-limitative embodiments of the invention, and by reference to the attached drawing in which.

DETAILED DESCRIPTION OF THE PREFERRED EMBODIMENTS

Figure 1:
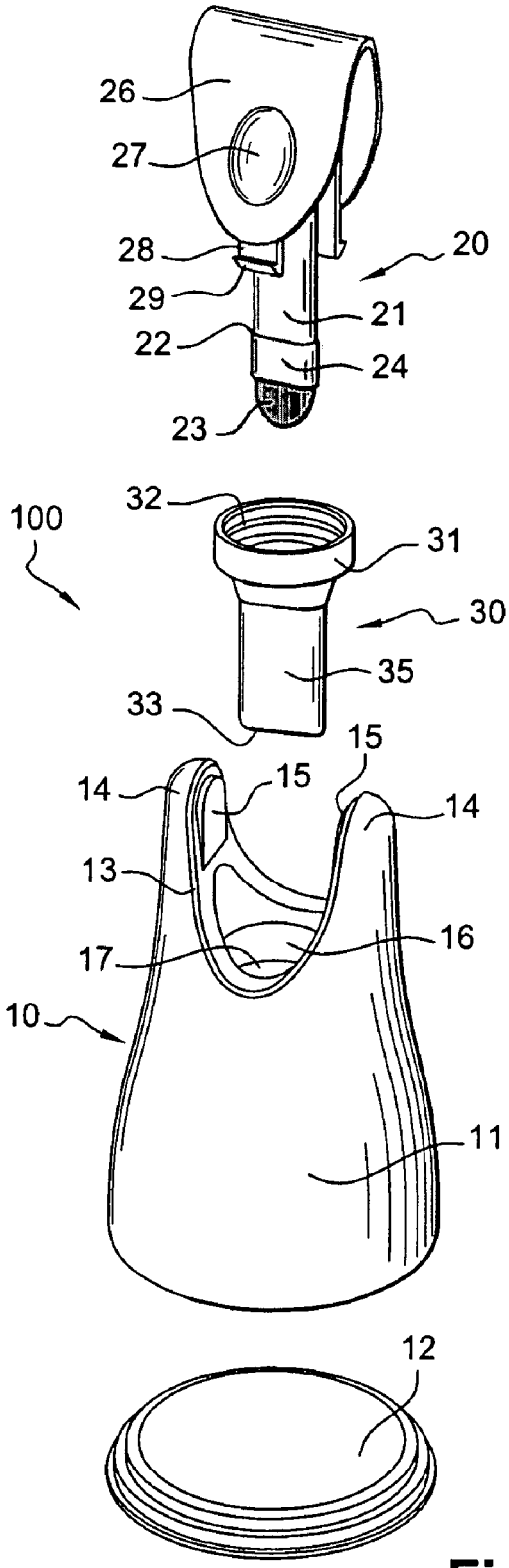
FIG. 1 illustrates an exploded view of a device for packaging and applying a product according to a preferred embodiment of the invention.

The exemplary packaging and applicator device 100 depicted in FIGS. 1 to 8 is designed for the application of a cosmetic product, for example, an eye shadow, a rouge, a blusher, or a foundation, etc. The product is preferably in loose powder form.

The device 100 includes a container 10 holding the product, an applicator 20 designed to be seated in the container in the closed position, and a wiper element 30 which can be traversed by the applicator.

The container 10 is elongated on an axis X. It includes a sidewall 11 of circular transverse cross-section which diminishes progressively between a base 12 and an upper edge 13. At its upper part, the container includes two arms 14, diametrically opposed, which extend on the axis X. The arms 14 are connected to each other by a concave portion such that the container 10 incorporates a U-shaped notch in its upper part. Each arm 14 includes a shoulder 15 on its inner surface, acting as a stop for the grasping element.

Substantially at the base of the U, the upper edge 13 of the container connects to a circular skirt 16 which extends axially inside the container. The circular skirt delineates the opening 17 in the container.

The skirt 16 includes a snap-on bead **16*a* on its outer surface, the bead 16*a* being designed to receive a wiper element 30** which will be described later.

The skirt 16 additionally includes, at its upper part, two diametrically opposed flanges 18, the function of which will be explained later in the description.

The container 10 includes a fitted base 12, which is for example ultrasonically welded by its periphery onto the sidewall 11, and in particular onto its inner surface. The base 12 can alternatively be snapped onto the sidewall 11.

The container 10 is obtained by injection moulding a thermoplastic material, in particular made of plastic. It is made of PCTA or SAN for example.

The container can be, advantageously, transparent thereby enabling the consumer to see the product from the outside and in particular its colour.

A wiper element 30 is provided around the opening in the container so that, as will be seen in detail below, it is traversed by the applicator. The wiper element includes a fixing skirt 31 of cylindrical shape which includes a snap-on bead 32 on its inner surface designed to engage with the counterpart snap-on bead **16*a* provided on the outer surface of the skirt 16** provided in the container.

The wiper element 30 diminishes in diameter from the cylindrical skirt 31 until it forms a rectangular portion 35 with the short sides of the rectangle rounded.

The rectangular portion diminishes progressively to an end 33 which emerges via an opening 34. The free edge of the end 33 forms a wiping lip.

Preferably, the wiper element can be made of a relatively flexible material, for example low density polyethylene (LDPE) so that, as will be seen later, it ensures effective leaktight closure of the container with respect to the product.

The applicator 20 can be a flat brush. It includes a flat rod 21, of lengthwise axis X, at a first end 22 of which is attached a tuft of bristles 23 via a ferrule 24. The tuft of bristles 23 is captive in the ferrule which is in turn crimped onto the end 22 of the rod, the bristles being oriented on the axis X of the rod. The tuft of bristles has substantially the same width and the same thickness as the rod.

Figure 2:
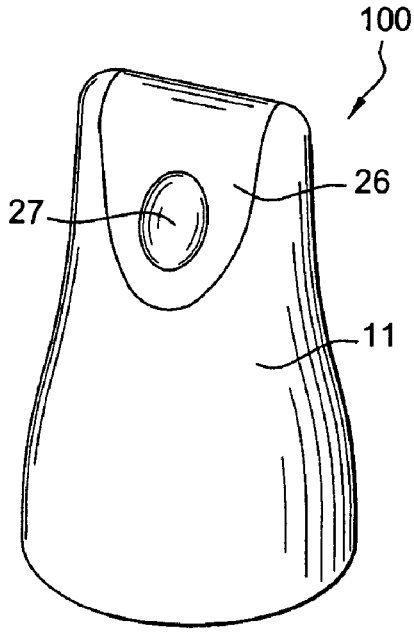
FIG. 2 illustrates a perspective view of the device in FIG. 1 in the assembled position.

A second end 25 of the rod, opposite the first, connects to a grasping portion 26 in the shape of an inverted U, which tapers slightly towards the outside. The outer surface of the grasping portion includes, on each lug, a domed surface 27 which facilitates grasping. In particular, the grasping portion is designed to be grasped and pinched between the thumb and index finger. When the applicator is mounted on the container, the grasping portion is seated in the notch provided in the upper part of the container and lies flush with the outer surface of the container, as can be seen in FIG. 2.

To attach the applicator to the container, two fixing lugs 28 are provided on the grasping portion. The two lugs 28 extend, parallel to and on either side of the rod, from each grasping portion, from the inner surface of the grasping portion. The fixing lugs 28 are rectangular in shape and include a hook 29 at their free end designed to snap onto the container. In particular, each hook 29 takes up a position under each flange 18 provided on the skirt 16. The shape of the hooks and that of the flanges, and the materials of which they are made, can be such that the action of snapping the applicator onto the container can be accompanied by an audible click which tells the user that the applicator is properly fitted on the container.

A sealing bead 40 is provided on the outer surface of the rod. The sealing bead can be designed to bear in a leaktight manner against the inner surface of the wiper element when the applicator is mounted on the container.

The bead 40 has a radial height of approximately 1.3 mm for example.

The axial position of the bead on the rod and its radial height can be selected relative to the wiper element in such a way that the bead 40 can bear in leaktight contact at different axial heights on the inner surface of the wiper element. The extent of the sealing zone can thus be increased so that even if the applicator is snapped onto the container at an axial height different from that initially provided, the bead will nonetheless remain in leaktight contact with the wiper element. The fact of using a bead which bears radially against the wiper element ensures leaktight closure vis-à-vis the product, with a fairly wide manufacturing tolerance.

A second bead can also be provided at a distance from the first to further improve the sealing tightness.

Figure 6:
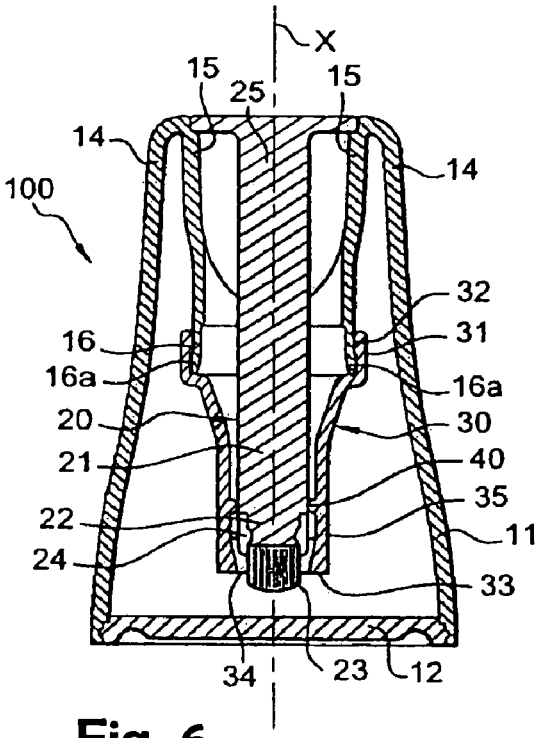
FIGS. 6 and 7 are sectional views of the device according another embodiment of the invention.
Figure 7:
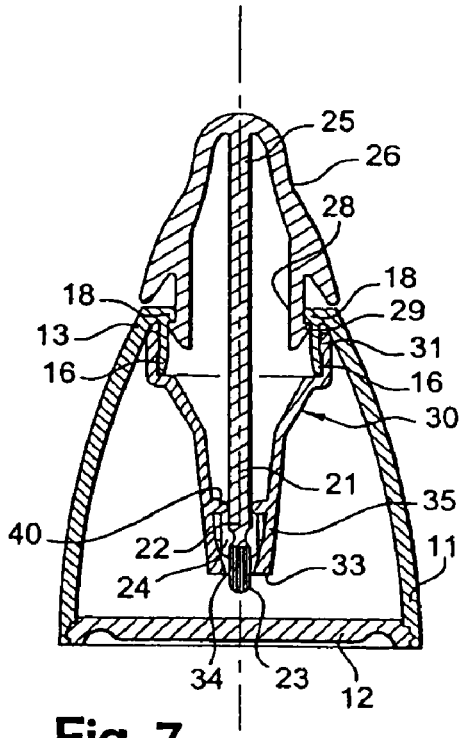
Figure 8:
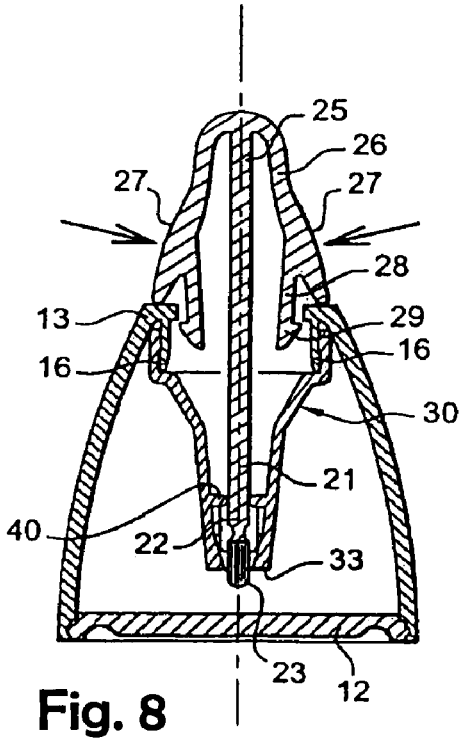
FIG. 8 illustrates a sectional view similar to that in FIG. 6, in the process of opening.

Instead of providing a sealing bead on the rod, it is possible as a variant to provide a bead on the inner surface of the wiper element, against which the applicator rod can bear in a leaktight manner. For example, as illustrated in FIGS. 6-8, the bead 40 is provided on the inner surface of the wiper element 30.

The bead or beads can also be replaced by a sealing lip.

Figure 3:
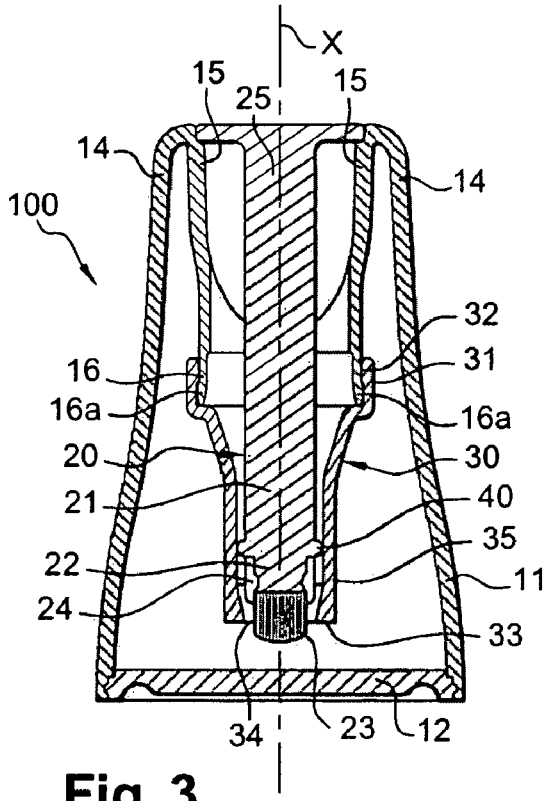
FIGS. 3 and 4 are sectional views of the device according an embodiment of the invention.
Figure 4:
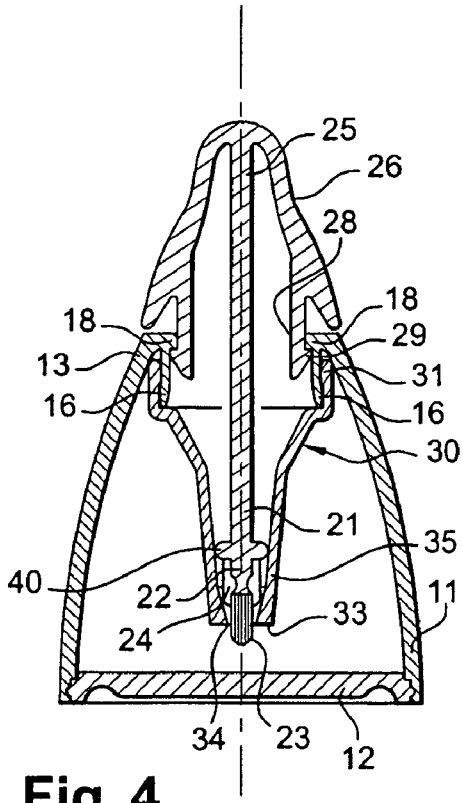

When the applicator is mounted on the container as can be seen in FIGS. 3 and 4, the bead 40 is in leaktight bearing contact against the inner surface of the wiper element. In this storage position, the powder present in the container cannot reach the portion of the rod situated above the bead and cannot therefore escape from the container. The risks of leakage of the product are thus limited.

In this storage position, the end of the tuft of bristles 23 can project beyond the opening 34 in the wiper element 30 over only a part of its axial height such that only this part can be loaded with product. In particular, the tuft of bristles 23 can project beyond the opening 34 in the wiper element by less than half of its length, for example, by approximately a third of its length. In addition, the end 33 of the wiper element has an internal cross-section relatively close to the cross-section of the tuft of bristles thereby leaving very little free space around the tuft of bristles so that a minimum of product is able to reach the inside of the wiper element.

Figure 5:
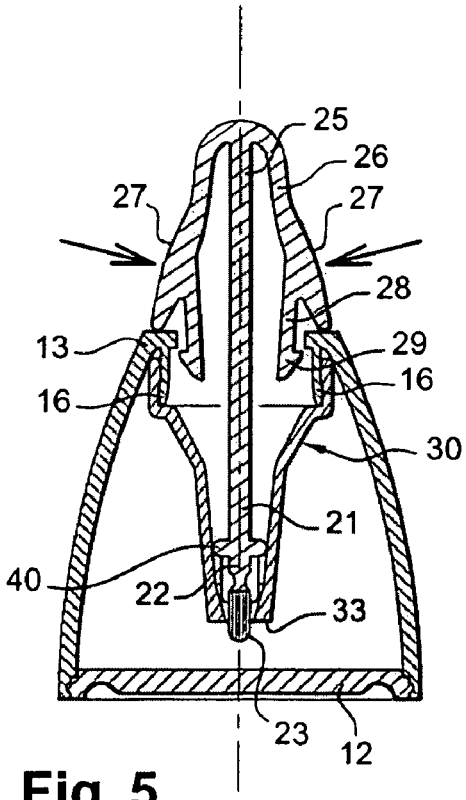
FIG. 5 illustrates a sectional view similar to that in FIG. 4, in the process of opening.

To load the applicator with product, the user shakes the device so that powder is deposited on the end of the brush. The user takes hold of the grasping element and pinches the two grasping portions 26 together so as to detach the applicator from the container as illustrated in FIG. 5, separating the hooks 29 from the flanges 18. The user can then withdraw the applicator 20 from the inside of the container by drawing it upwards substantially along the axis X. During this withdrawal movement, the end of the tuft of bristles loaded with product is scraped by the end of the wiper element thereby removing the surplus product. The user can then apply the applicator thus loaded with product onto the area he/she wishes to make up.

After applying the product, the user reinserts the applicator 20 into the container until the "click" is heard confirming that the applicator is properly attached on the container and that the bead 40 is in leaktight bearing contact against the inner surface of the wiper element 30 so that the container is sealed vis-à-vis the product.

To manufacture the packaging device just described, the container 10 can be made by moulding separately from the base 12, the applicator and the wiper element. The wiper element 30 can be then attached to the skirt 16 of the container, on the one hand, and the applicator 20 can be fitted onto the container, on the other hand. The container is filled with product in this configuration, via its bottom portion which is not closed off by the base 12. Once filled, the container is closed off by the base 12.

In the foregoing detailed description reference is made to preferred embodiments of the invention. It is evident that variants thereto can be proposed without departing from the invention as claimed here below. In particular, instead of using a tuft of bristles, the applicator can be made of foam, with or without flock covering, or it can be made of felt.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for packaging and applying a cosmetic product, said device comprising:

a container defining an opening;

an applicator including:

a rod, an applicator element at a first end of the rod, and a grasping portion connected to a second end of the rod, said grasping portion including two resilient engagement elements, the applicator being configured to be attached by compressing the grasping portion, such that the two engagement elements snap onto the container so as to accommodate the applicator element in the container; and a wiper element fixed in the container in proximity to the opening, the wiper element being open at its lower end to allow the applicator element to pass through at least partially when the applicator is mounted on the container;

wherein the rod is in leaktight bearing contact substantially perpendicular to a lengthwise axis of the rod on an inner surface of the wiper element thereby closing the container in a leaktight manner when the applicator is mounted on the container.

2. A device according to claim 1, wherein the rod includes at least one bead bearing in leaktight contact against the inner surface of the wiper element when the applicator is mounted on the container.

3. A device according to claim 1, wherein the wiper element includes a bead on its inner surface on which the rod is designed to bear in a leaktight manner.

4. A device according to claim 1, wherein the wiper element has a transverse cross-section that diminishes progressively towards its lower end.

5. A device according to claim 1, wherein the rod is flat.

6. A device according to claim 1, wherein the applicator projects beyond the wiper element inside the container over only a part of its length.

7. A device according to claim 6, wherein the applicator projects beyond the wiper element inside the container over less than half its length.

8. A device according to claim 7, wherein the applicator is a brush.

9. A device according to claim 1, wherein the lower end of the applicator is in proximity to a base of the container when the applicator is mounted on the container.

10. A device according to claim 1, wherein the applicator includes two fixing lugs incorporating a hook designed to snap onto the container.

11. A device according to claim 10, wherein the two fixing lugs are mutually parallel.

12. A device according to claim 10, wherein the fixing lugs are designed to tilt about an axis perpendicular to the axis of the rod, by moving towards the rod.

13. A device according to claim 10, wherein the two fixing lugs are located on either side of the rod.

14. A device according to claim 10, wherein the grasping portion includes two bearing surfaces.

15. A device according to claim 1, wherein the container has a fitted base.

16. A device according to claim 1, wherein the container includes a skirt defining an opening in the container, the skirt extending inside the container.

17. A device according to claim 16, wherein the wiper element is fixed around the skirt.

18. A device according to claim 1, wherein the container contains said cosmetic product.

19. A device according to claim 18, wherein said cosmetic product is in a loose powder form.

20. A device according to claim 18, wherein said cosmetic product is at least one of an eye shadow, a rouge, a blusher, or a foundation.

21. A device for packaging a cosmetic product, said device comprising:

a container defining an opening;

a wiper element coupled to the container; and an applicator including:

a rod including a top portion and a bottom portion, an applicator element coupled to said bottom portion of said rod, and a grasping portion coupled to said top portion of said rod, said grasping portion including two flexible extensions that extend from said top portion of said rod in a direction substantially towards said bottom portion of said rod, said two extensions positioned on mutually opposite sides of said rod;

wherein, when said applicator is mounted on said container, said grasping portion is outside said container, said applicator element at least partially passes through said wiper element and is exposed to an inside of said container, and said applicator and an inner surface of said wiper element are configured to contact each other so as to seal off said inside of said container.

22. A device according to claim 21, wherein said rod of said applicator includes a bead configured to contact against said inner surface of said wiper element so as to seal off said inside of said container.

23. A device according to claim 21, wherein said inner surface of said wiper element includes a bead configured to contact said rod of said applicator so as to seal off said inside of said container.

24. A device according to claim 21, wherein said applicator is configured to snap-fit onto said container.

25. A device for packaging a cosmetic product, said device comprising:

a container including two arms defining a notch;

a shoulder, positioned on an interior surface of each arm;

a wiper element coupled to the container; and an applicator including:

a rod, an applicator element coupled to said rod, and a grasping portion coupled to said rod, wherein, when said applicator is mounted on said container, said applicator element at least partially passes through said wiper element, and said grasping portion is seated in said notch and over said shoulders and lies flush with an outer surface of said container, wherein, when said applicator is mounted on said container, said applicator and said wiper element form a seal, and wherein said rod of said applicator is in contact with said inner surface of said wiper element and said contact forms said seal.

26. A device according to claim 25, wherein, when said applicator is mounted on said container, said arms of said container defining said notch do not extend beyond said grasping portion.

27. A device according to claim 25, wherein said grasping portion includes at least one domed surface to facilitate grasping.

28. A device according to claim 25, wherein said contact is substantially perpendicular to a lengthwise axis of said rod.

29. A device according to claim 21, wherein said grasping portion includes at least one domed surface to facilitate grasping.

30. A device according to claim 21, wherein said grasping portion includes at least two fixing lugs attached to said extensions, said lugs each having a hook configured to snap onto said container.

31. A device according to claim 21, wherein said extensions form a dome over said bottom portion of said rod.

32. A device according to claim 21, wherein, when said applicator is mounted on said container, said grasping portion is flush with an outer surface of said container.

33. A device according to claim 21, wherein said extensions are configured such that when pinched, a bottom edge of said extensions will contact said container and said hooks will disengage from said container.

34. A device according to claim 25, wherein said grasping portion includes an apex formed above said rod, said apex having an outer surface that lies flush with an outer surface of said arms.

35. A device according to claim 34, wherein said grasping portion is dome shaped.

36. A device according to claim 34, wherein said arms extend away from an opening defined by said container.

37. A device according to claim 36, wherein said notch defines a U-shape, said U-shape being positioned above said opening and framed by said arms.

38. A device according to claim 37, wherein said shoulders are positioned such that an exterior surface of said shoulders is perpendicular to a plane bisecting said arms.

39. A device according to claim 38, wherein said shoulders protrude toward said opening and are dome shaped, such that a vertical axis of an apex of said shoulders is coaxial with a vertical axis of said apex of said grasping portion.

* * * * *